United States Patent [19]

Pawlowski

[11] 4,158,120

[45] Jun. 12, 1979

[54] ELECTRIC AND AIR SIGNAL ELEMENT

[76] Inventor: Eugene J. Pawlowski, 10621 Bloomfield Ave., Unit 32, Los Alamitos, Calif. 90720

[21] Appl. No.: 877,495

[22] Filed: Feb. 13, 1978

[51] Int. Cl.[2] ..... H01H 3/20; H01H 35/38

[52] U.S. Cl. ..... 200/330; 200/82 C; 92/5 R

[58] Field of Search ..... 200/330, 340, 293, 81 R, 200/81.9, 82 R, 82 C, 306, 308; 92/5 R

[56] References Cited

U.S. PATENT DOCUMENTS

| | | | |
|---|---|---|---|
| 2,916,576 | 12/1959 | Croskey et al. | 200/82 C X |
| 3,043,929 | 7/1962 | Guthrie | 200/82 C |
| 3,118,030 | 1/1964 | Palen | 200/82 C |
| 3,261,958 | 7/1966 | Bittner | 200/330 |
| 3,449,535 | 6/1969 | Otto et al. | 200/82 C |
| 3,614,352 | 10/1971 | Wiese | 200/330 X |
| 3,661,053 | 5/1972 | Rich | 92/5 R X |

*Primary Examiner*—William Price
*Assistant Examiner*—Steven M. Pollard

[57] ABSTRACT

An electric switch actuator having a housing with a switch cavity and an associated bore. A spring biased piston is contained within the bore and actuates the switch in response to pressure. The switch cavity is closed by a transparent window allowing the switch actuation to be viewed.

3 Claims, 7 Drawing Figures

ELECTRIC AND AIR SIGNAL ELEMENT

BACKGROUND OF THE INVENTION

It is known that to provide a pneumatic means of switch actuation several devices and a housing are often crammed in limited space of a logic system. This invention will provide a proper hook up in the brief space of one logic element. A particular advantage is the adaptability of this invention to a choice of associated logic elements to effect the following functions; namely: And, Or, Not, Pulse, Delay In, Delay Out. To interchange said associated elements requires the removal of only two threaded nuts. An additional advantage is the transparent cover allowing observation of the switch actuation.

SUMMARY OF THE INVENTION

A principal object of this invention is to provide visual electric switch actuation and simultaneously continue the output of a logic element, to which the switch actuator is attached, when connected to a cylinder and/or a power source. Output begins when input pressure reaches 65% of normal working pressure. This invention eliminates the use of round about hookups of tubing, fittings, and extra devices while also being a base for a logic element.

DETAILED DESCRIPTION OF THE INVENTION

Figures 1, 2, 3, 4:
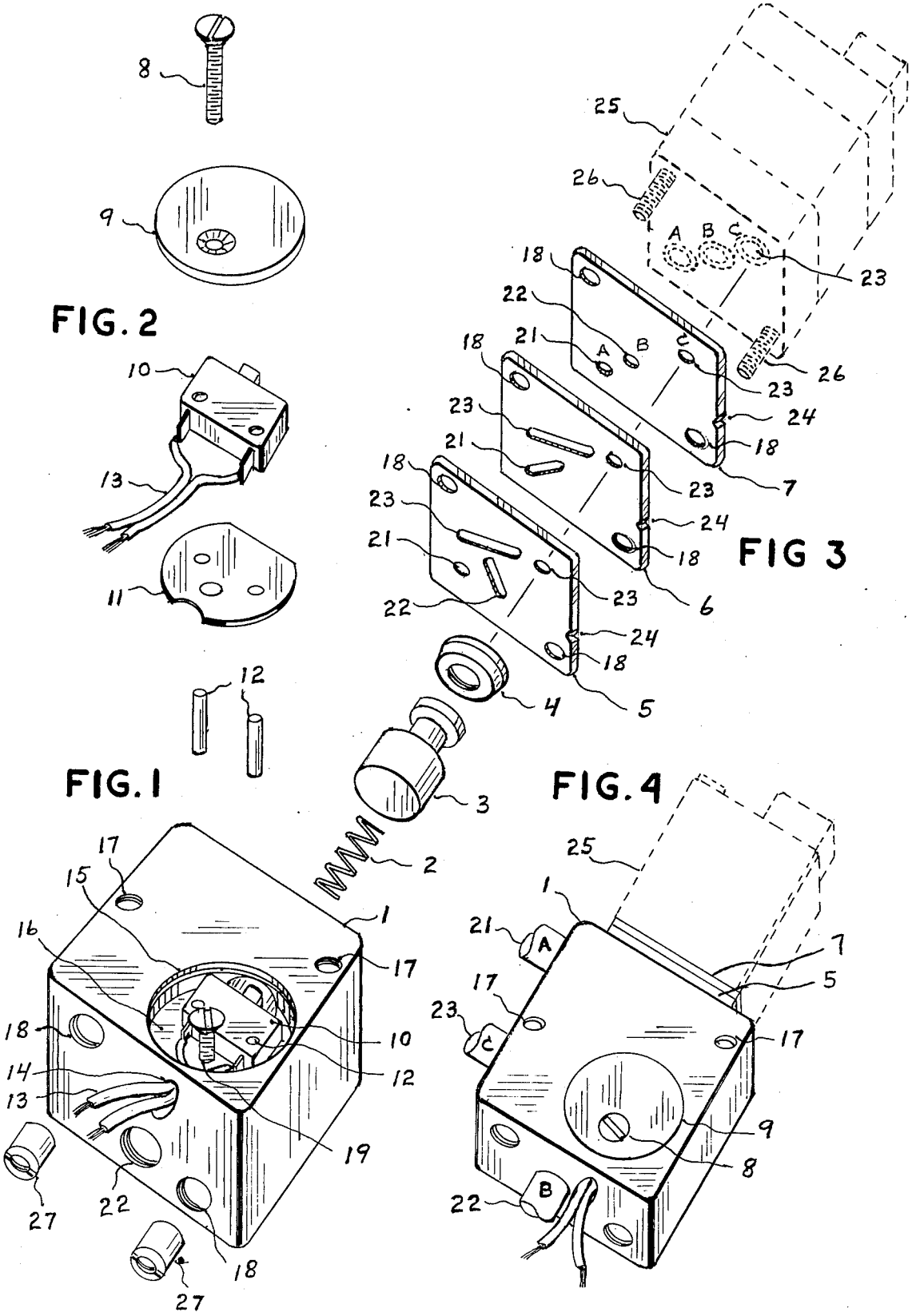
FIG. 1 is a perspective view of an electric switch actuator according to the present invention.
FIG. 2 is an exploded view showing two locating pins, an insulation disc, an electric switch, transparent cover, and retention screw of the present invention.
FIG. 3 is an exploded view showing the biasing spring, piston, seal, two interchangeable gaskets, and a manifold plate of the present invention.
FIG. 4 is a perspective view of the electric switch actuator of the present invention with a logic element attached.

As shown in FIG. 1, the electric switch actuator according to the present invention includes a switch housing 1 of square shape having a cavity 16 located in the upper surface of the housing. An electric switch 10 is located within the carity and held in place by locator pins 12 and a transparent window 9 covering the cavity. An insulating disc 11 is located between the switch 10 and the cavity base. This arrangement is shown exploded in FIG. 2.

Figure 5:
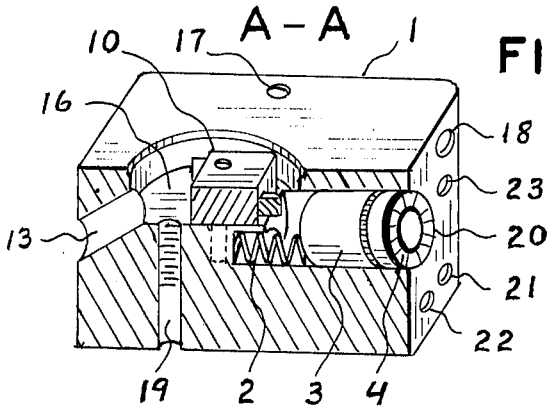
FIG. 5 is a sectional view of the electric switch actuator of the present invention.
Figure 6:
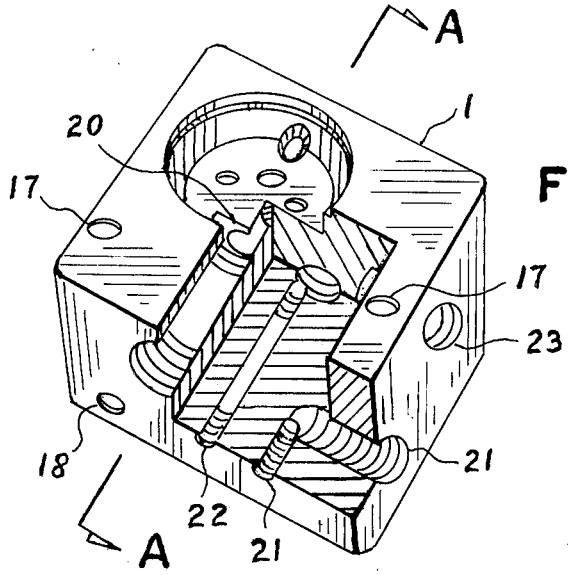
FIG. 6 is a sectional view of the electric switch actuator of the present invention showing the location of air passages.
Figure 7:
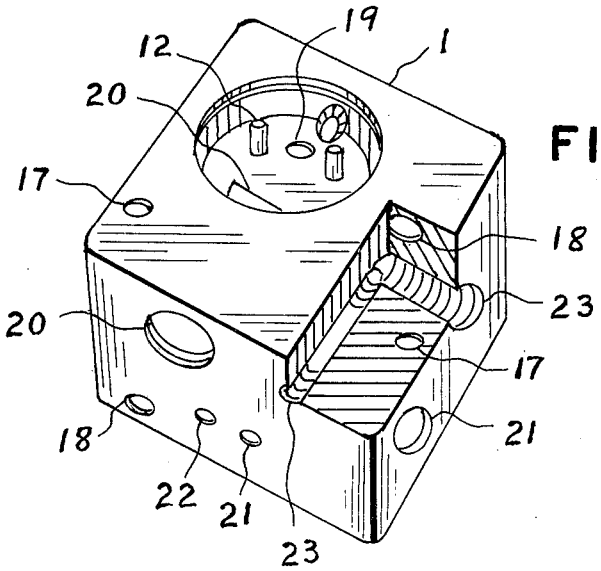
FIG. 7 is a sectional view of the electric switch actuator of the present invention showing the location of a primary air passage in relation to other air passages.

The switch 10 is activated by air pressure acting on a piston 3 located within an actuating bore 20. The bore 20 extends through the housing 1 from an exterior wall to the cavity 16. The bore having a bottom located below the cavity. A spring 2 is located between the bore bottom and piston 3 biasing the piston away from switch 10. Air pressure moves piston 3 inwardly actuating switch 10. The bottom of bore 20 limits the piston movement, preventing damage to the switch from the piston. The sectional arrangement of the actuator is shown in FIG. 5.

Piston 3 has a cup seal 4 contained by a groove. Interchangable gaskets 5, 6 are employed at the exterior wall, of the switch housing 1, containing the bore 20. The end of the piston facing the gasket is reduced in diameter for easy assembly of the seal and piston. The piston 3 is moved inwardly by air flowing through air passage 23 following the centerline in FIG. 3.

The gasket 5 and plate 7 have two inlet air passages 21 and 22. Associated logic element 25 has one output passage 23 to actuate piston 3 and continue through output port 23. Gaskets 5 and 6 have a thickness suitable to allow cutaway air passages to connect with air passages on the face of housing 1. Gasket 6 is similar to gasket 5 with the exception that gasket 6 has only one inlet passage 21 connecting passages 21 and 22 of plate 7.

Plate 7 is employed to shift the flow of air to and from the actuator when attached to a logic element 25, and distributes air through the holes and cutouts of gaskets 5, 6. A notch or mark 24 on one side of gaskets 5, 6 and plate 7 identifies their orientation with respect to housing 1.

Transparent window 9 is fitted into recess 15 to cover the switch cavity 16 and retain switch 10 in position. A nylon flat headed screw 8 fits into a countersunk hole in window 9 and threaded hole 19 located in the cavity base.

The switch 10 has attached wires 13 contained by an upwardly angled hole 14 extending from an exterior wall of the switch housing to a wall of the cavity. The upwardly angled hole aids in upward removal of the switch 10 from the cavity 16 without disconnecting the wires 13 from the switch 10.

Two threaded nuts 27 and connecting studs 26 are located in countersunk holes 18 in the housing to retain in position the assembly shown in FIG. 1 and 3. Holes 17 are for installation purposes.

I claim:

1. A pressure responsive electric switch actuator having a switch housing with a cavity located in the upper surface of said switch housing for the containment of a switch means, and an associated actuating bore, said cavity having a base with upwardly projecting locator pins mounted perpendicularly to said base for locating said switch means, a transparent window closing said cavity allowing observation of said switch means and retaining said switch means and retaining said switch means in position, said actuating bore, being connected to said cavity, having a pressure responsive piston contained therein for actuating said switch means, biased by spring means, said bore having a bottom located below said cavity base and a portion of said bore open to said cavity, said spring means being contained within said bore between said bottom and said piston.

2. A pressure responsive electric switch actuator according to claim 8 in which the switch housing has an upwardly angled hole extending from an exterior wall of said switch housing to a wall of said cavity wherein wires attached to said switch are contained by said upwardly angled hole allowing upward removal of said switch.

3. A pressure responsive electric switch actuator according to claim 1 or 2 having a gasket and manifold plate located between the housing exterior wall containing the actuating bore and associated logic element, the condifuration of said gasket and manifold plate to effect a simultaneous switch actuation and continue the original output signal, while being a base for said associated logic element.

* * * * *